US012808101B2

(12) United States Patent
Nakata et al.

(10) Patent No.: US 12,808,101 B2
(45) Date of Patent: Nov. 24, 2026

(54) FIBER STRUCTURE MANUFACTURING APPARATUS

(71) Applicant: SEIKO EPSON CORPORATION, Tokyo (JP)

(72) Inventors: Hirofumi Nakata, Matsumoto (JP); Hirokazu Yamaga, Chino (JP); Masafumi Sakaguchi, Suwa (JP); Yuka Kato, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 18/768,071

(22) Filed: Jul. 10, 2024

(65) Prior Publication Data

US 2025/0019878 A1 Jan. 16, 2025

(30) Foreign Application Priority Data

Jul. 12, 2023 (JP) ..... 2023-114319

(51) Int. Cl.

| | |
|---|---|
| ***D04H 1/4382*** | (2012.01) |
| ***D04H 1/425*** | (2012.01) |
| ***D04H 1/541*** | (2012.01) |
| ***D04H 1/732*** | (2012.01) |

(52) U.S. Cl.

CPC ..... *D04H 1/43835* (2020.05); *D04H 1/425* (2013.01); *D04H 1/43828* (2020.05); *D04H 1/5412* (2020.05); *D04H 1/732* (2013.01); *D10B 2401/04* (2013.01)

(58) Field of Classification Search

CPC ..... D04H 1/43835; D04H 1/425; D04H 1/43828; D04H 1/5412; D04H 1/732; D10B 2401/04

See application file for complete search history.

(56) References Cited

U.S. PATENT DOCUMENTS

| | | | | |
|---|---|---|---|---|
| 10,647,022 | B2 * | 5/2020 | Nagai | B27N 3/12 |
| 10,675,777 | B2 * | 6/2020 | Higuchi | B27N 3/146 |
| 10,843,373 | B2 * | 11/2020 | Ueno | B27N 3/14 |
| 10,876,255 | B2 * | 12/2020 | Kunugi | D21D 5/18 |
| 10,914,034 | B2 * | 2/2021 | Higuchi | D21F 2/00 |
| 11,008,707 | B2 * | 5/2021 | Yoda | D21H 21/06 |
| 11,090,591 | B2 * | 8/2021 | Miyazawa | B01D 45/14 |

(Continued)

FOREIGN PATENT DOCUMENTS

| | | |
|---|---|---|
| JP | H07-003537 A | 1/1995 |
| JP | 2021-088783 A | 6/2021 |

*Primary Examiner* — Bao-Thieu L Nguyen

(74) *Attorney, Agent, or Firm* — Spencer Fane LLP

(57) ABSTRACT

A fiber structure manufacturing apparatus includes: a defibrated material supplying unit that supplies a defibrated material obtained by defibrating a material that contains fibers; a resin supplying unit that supplies resin fibers; a mixing unit; an accumulation unit; and a shape molding unit, wherein the resin supplying unit includes a fragmenting unit that produces resin fiber fragments by performing fragmentation of a cotton-like lump of the resin fibers, a constant amount supplying unit that supplies a constant amount of the resin fiber fragments produced by the fragmenting unit, a loosening unit that loosens the resin fiber fragments supplied from the constant amount supplying unit to decrease density of the resin fiber fragments, and a transferring unit that transfers the resin fibers like a cotton loosened by the loosening unit to the mixing unit.

6 Claims, 5 Drawing Sheets

(56) References Cited

U.S. PATENT DOCUMENTS 11,193,238 B2 * 12/2021 Oguchi ..... D21F 9/00
11,332,331 B2 * 5/2022 Tanaka ..... D21B 1/32
11,384,482 B2 * 7/2022 Inaba ..... D21F 7/008
11,697,224 B2 * 7/2023 Nakai ..... D21H 21/52
264/109
11,753,768 B2 * 9/2023 Nagai ..... D21F 7/003
162/207
11,753,769 B2 * 9/2023 Nakamura ..... D21F 9/00
162/175
11,807,988 B2 * 11/2023 Nakamura ..... D21F 11/06
11,866,885 B2 * 1/2024 Nakamura ..... D21H 11/14
12,286,755 B2 * 4/2025 Wakabayashi ..... D21H 21/52
2016/0121564 A1 * 5/2016 Oguchi ..... D04H 1/425
425/140
2016/0145802 A1 * 5/2016 Higuchi ..... D04H 1/732
162/373
2016/0229093 A1 * 8/2016 Gomi ..... D04H 1/60
2018/0057966 A1 * 3/2018 Spittle ..... D01G 9/06
2018/0305867 A1 * 10/2018 Yoshioka ..... D21B 1/325
2018/0347115 A1 * 12/2018 Oguchi ..... B27N 3/04
2019/0263018 A1 * 8/2019 Watarai ..... D21B 1/028
2019/0264390 A1 * 8/2019 Nakata ..... D21F 2/00
2019/0270220 A1 * 9/2019 Oguchi ..... D21G 9/0036
2019/0309475 A1 * 10/2019 Inagaki ..... D21G 9/0009
2020/0002894 A1 * 1/2020 Higuchi ..... D04H 1/732
2020/0080262 A1 * 3/2020 Sago ..... D21H 21/06
2020/0101637 A1 * 4/2020 Yoda ..... D04H 1/732
2020/0131705 A1 * 4/2020 Higuchi ..... D04H 1/736
2020/0149219 A1 * 5/2020 Nakata ..... D21B 1/061
2021/0095400 A1 * 4/2021 Kobayashi ..... D01G 15/20
2021/0206019 A1 * 7/2021 Miyazawa ..... B27N 3/04
2021/0276050 A1 * 9/2021 Nagai ..... D21F 5/022
2021/0324555 A1 * 10/2021 Yoda ..... D21B 1/06
2024/0018693 A1 * 1/2024 Ota ..... B32B 5/271
2025/0018609 A1 * 1/2025 Nakata ..... B29B 9/14

* cited by examiner

FIBER STRUCTURE MANUFACTURING APPARATUS

The present application is based on, and claims priority from JP Application Serial Number 2023-114319, filed Jul. 12, 2023, the disclosure of which is hereby incorporated by reference herein in its entirety.

BACKGROUND

1. Technical Field

An embodiment of the present disclosure relates to a fiber structure manufacturing apparatus.

2. Related Art

A fiber structure manufacturing apparatus according to related art includes a coarse crushing unit that coarsely crushes wastepaper, a defibrating unit that defibrates the coarsely crushed pieces obtained at the coarse crushing unit, a supplying unit that supplies a binder to a defibrated material of cellulose fibers obtained at the defibrating unit, a mixing unit that produces a mixture by mixing the defibrated material with the binder, an accumulation unit that causes the mixture to accumulate on a plane, and a shape molding unit that applies heat and pressure to a web formed by accumulation of the mixture and thereby molds the web into a sheet shape.

As the binder supplied by the supplying unit mentioned above, a resin that is in fibrous form is sometimes used, besides a resin that is in powder form. In such a case, an automatic cotton supply amount controller such as one disclosed in JP-A-7-3537 can be used as the supplying unit. The automatic cotton supply amount controller is configured to weigh a cotton-like lump of fibers and discharge a cotton-like lump of fibers having a target weight.

However, if such an automatic cotton supply amount controller is applied to the supplying unit of the fiber structure manufacturing apparatus described above, it follows that a lump of cellulose fibers and a lump of resin fibers are mixed at the mixing unit. In this case, the lump of cellulose fibers and the lump of resin fibers are mixed as they are, without being loosened. Therefore, dispersion and mixing of the fibers will be insufficient. For this reason, the strength, etc. of the fiber structure that is obtained will not be uniform, resulting in a decrease in quality of the fiber structure.

SUMMARY

A fiber structure manufacturing apparatus according to a certain aspect of the present disclosure includes: a defibrated material supplying unit that supplies a defibrated material obtained by defibrating a material that contains fibers; a resin supplying unit that supplies resin fibers; a mixing unit that produces a mixture by mixing the defibrated material with the resin fibers; an accumulation unit that produces an accumulated material by causing the mixture to accumulate; and a shape molding unit that produces a fiber structure by performing shape molding of the accumulated material, wherein the resin supplying unit includes a fragmenting unit that produces resin fiber fragments by performing fragmentation of a cotton-like lump of the resin fibers, a constant amount supplying unit that supplies a constant amount of the resin fiber fragments produced by the fragmenting unit, a loosening unit that loosens the resin fiber fragments supplied from the constant amount supplying unit to decrease density of the resin fiber fragments, and a transferring unit that transfers the resin fibers like a cotton loosened by the loosening unit to the mixing unit.

DESCRIPTION OF EMBODIMENTS

Based on a non-limiting preferred embodiment illustrated in the accompanying drawings, a fiber structure manufacturing apparatus according to the present disclosure will now be explained in detail.

Embodiment

Figure 1:
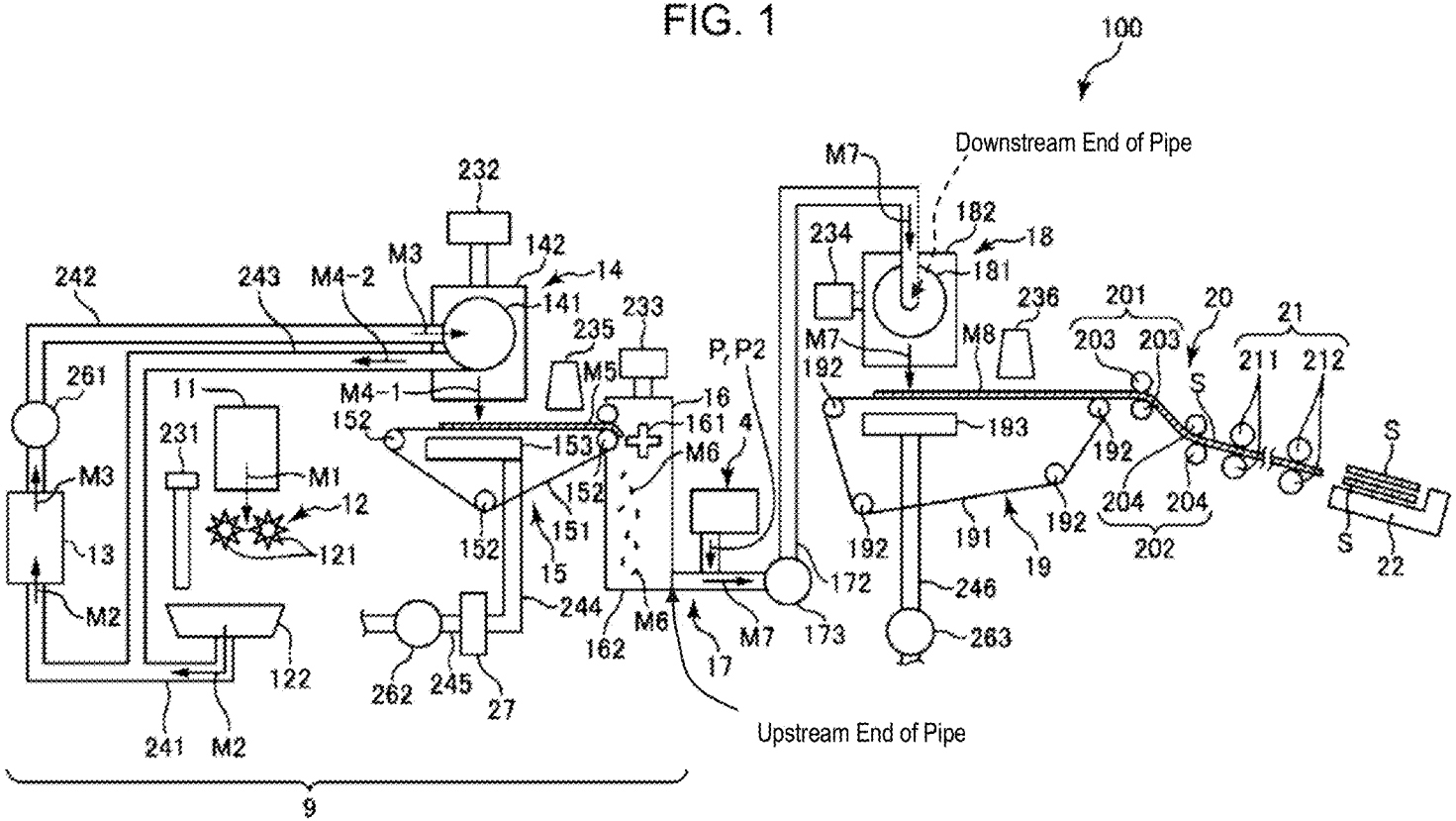
FIG. 1 is a diagram that schematically illustrates the structure of a fiber structure manufacturing apparatus according to an embodiment of the present disclosure.
Figure 2:
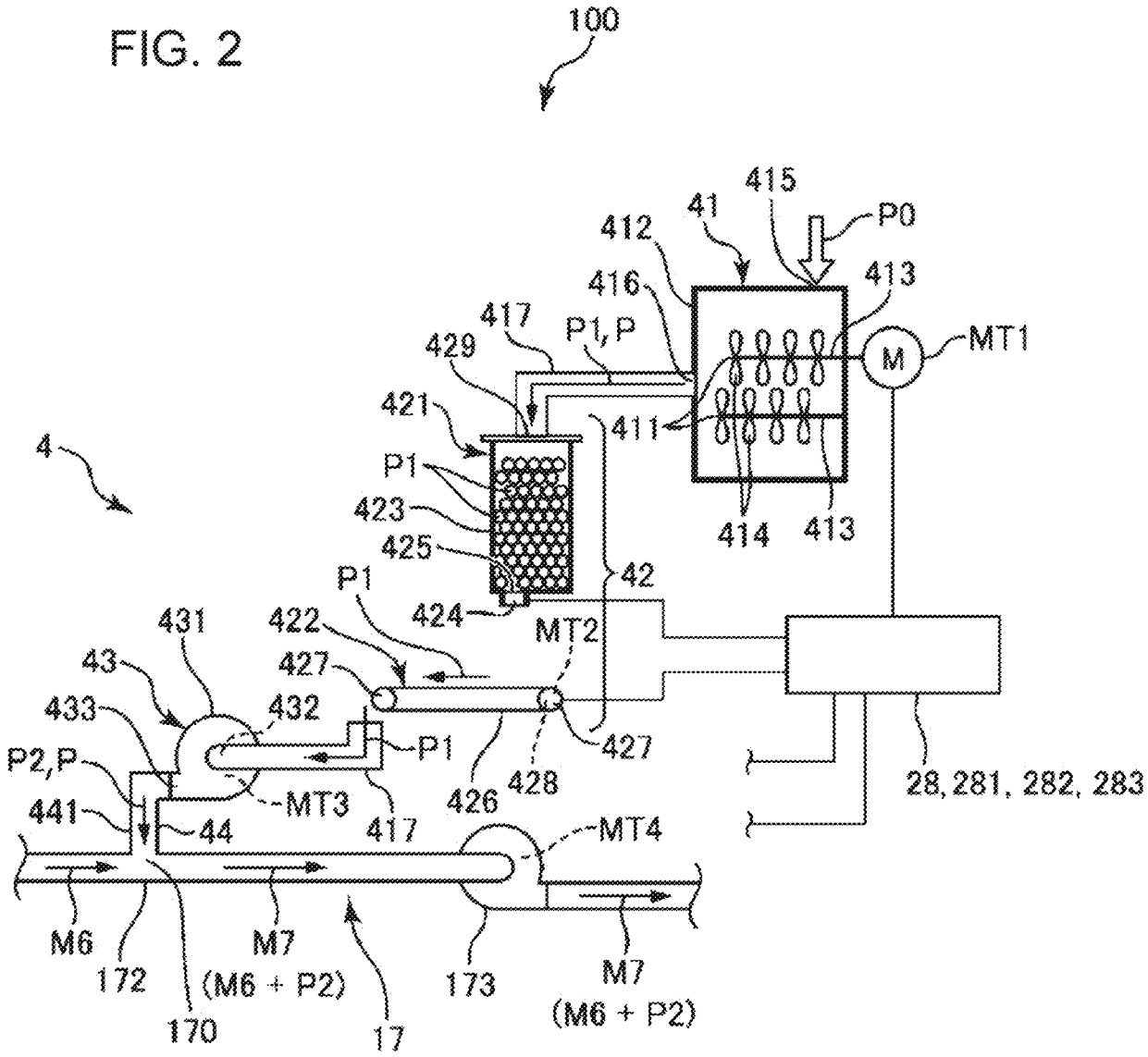
FIG. 2 is a diagram that schematically illustrates the structure of a resin supplying unit and a mixing unit illustrated in FIG. 1.
Figure 3:
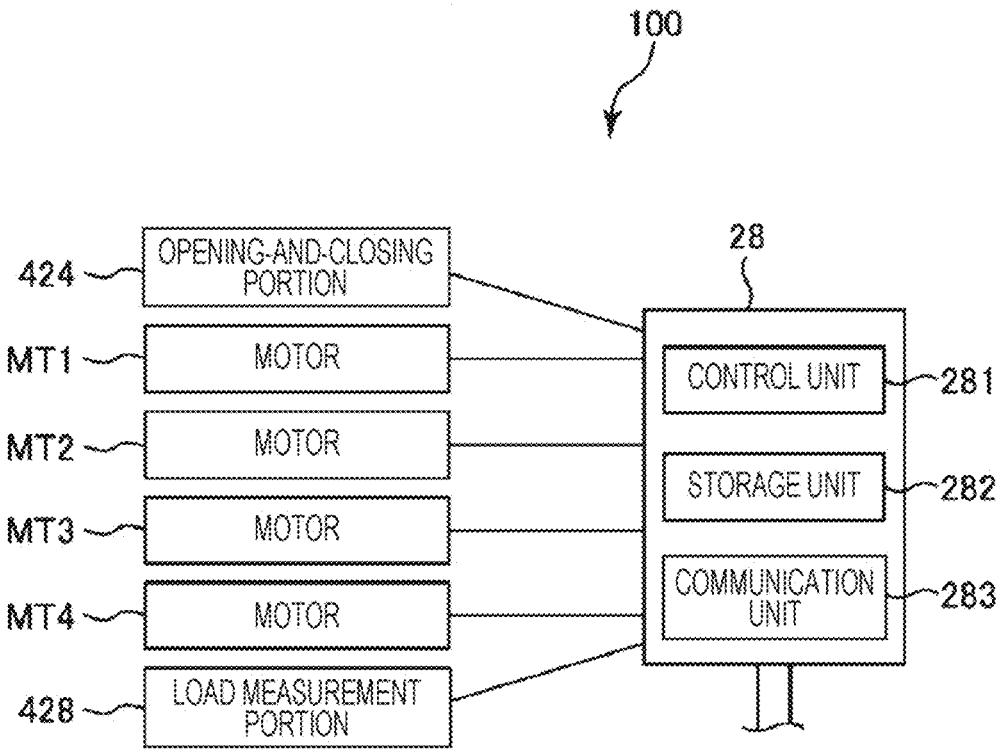
FIG. 3 is a block diagram of the fiber structure manufacturing apparatus illustrated in FIG. 1.
Figure 4:
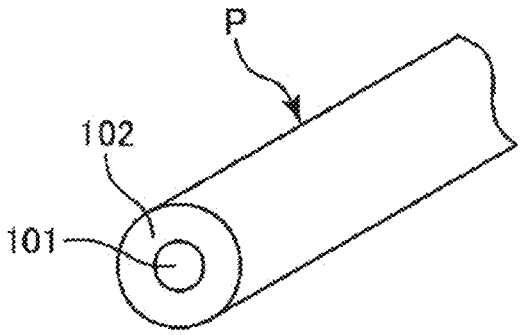
FIG. 4 is an enlarged perspective view of a resin fiber supplied by the resin supplying unit illustrated in FIG. 1.
Figure 5:
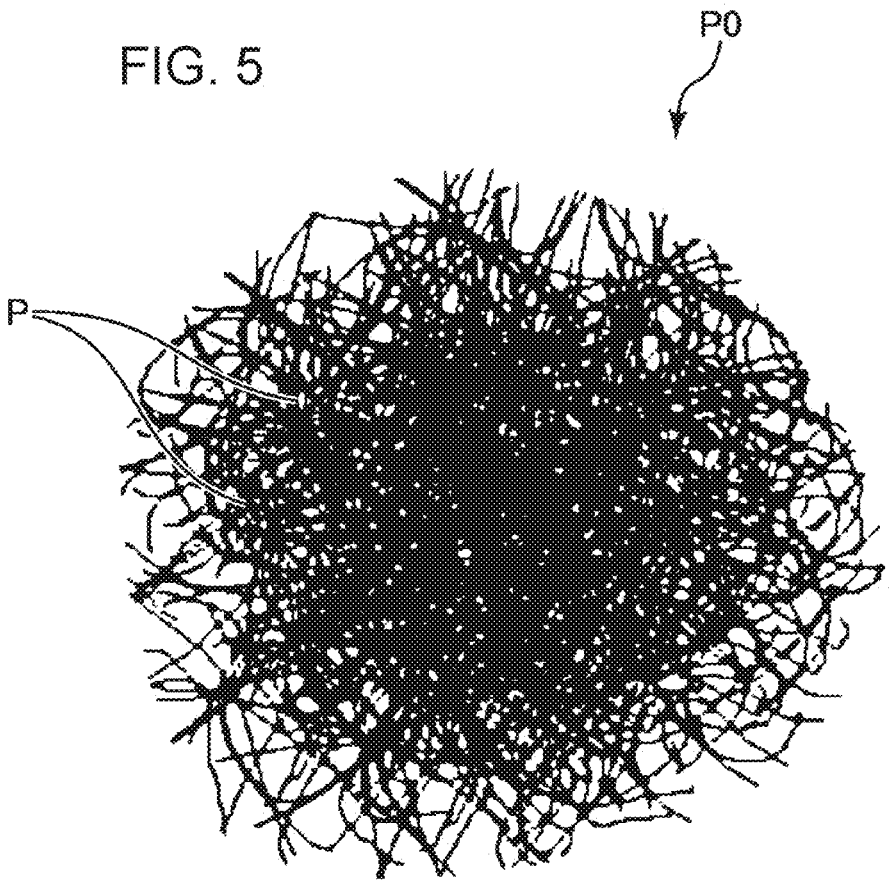
FIG. 5 is a diagram that illustrates a cotton-like lump of resin fibers.
Figure 6:
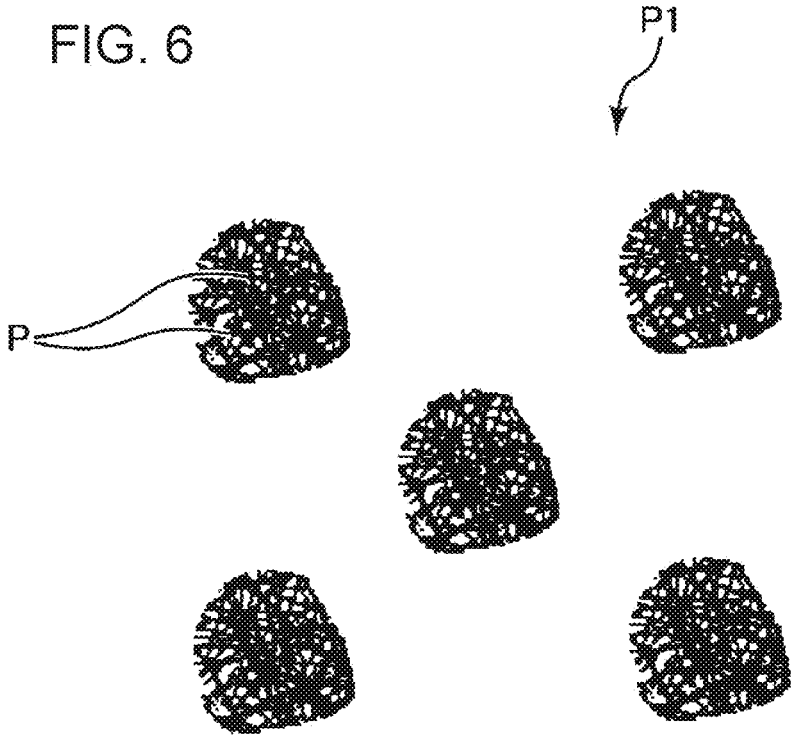
FIG. 6 is a diagram that illustrates resin fiber fragments.
Figure 7:
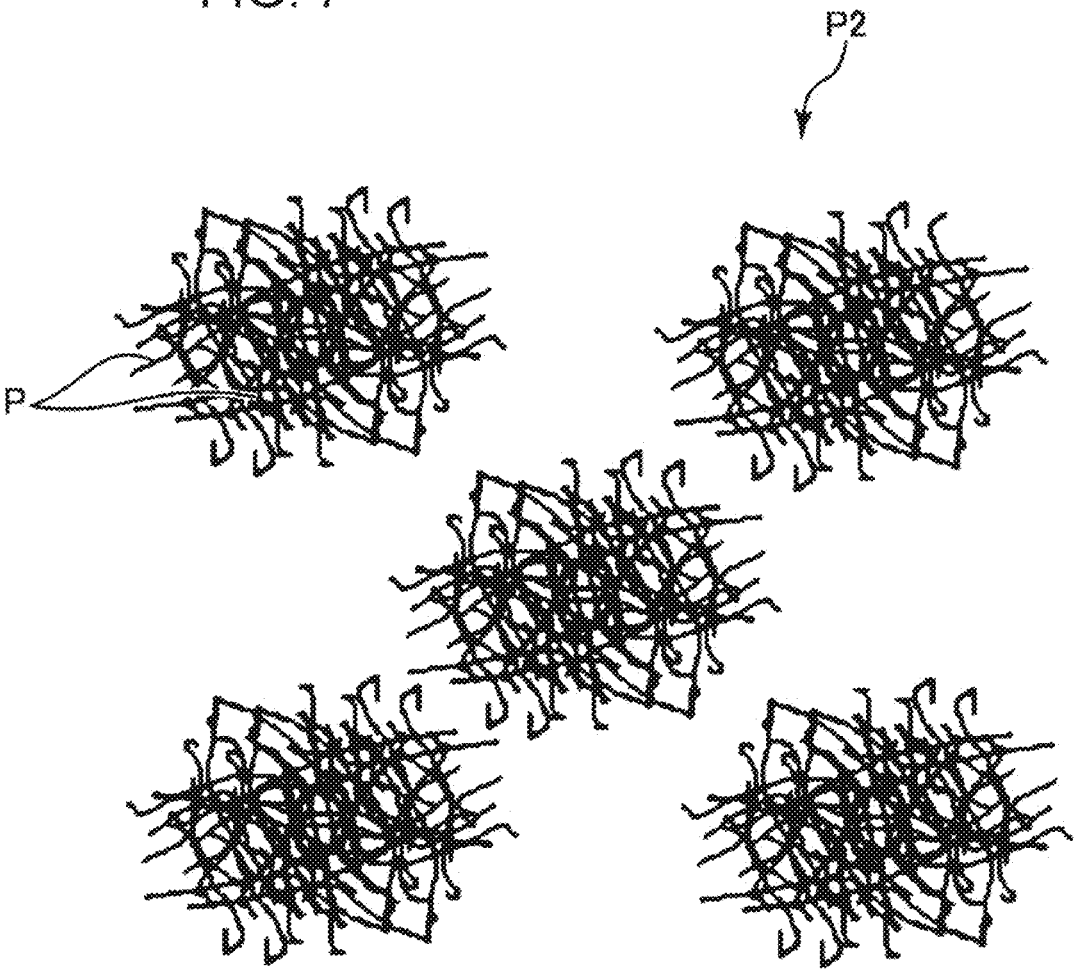
FIG. 7 is a diagram that illustrates loosened resin fibers.

FIG. 1 is a diagram that schematically illustrates the structure of a fiber structure manufacturing apparatus according to an embodiment of the present disclosure. FIG. 2 is a diagram that schematically illustrates the structure of a resin supplying unit and a mixing unit illustrated in FIG. 1. FIG. 3 is a block diagram of the fiber structure manufacturing apparatus illustrated in FIG. 1. FIG. 4 is an enlarged perspective view of a resin fiber supplied by the resin supplying unit illustrated in FIG. 1. FIG. 5 is a diagram that illustrates a cotton-like lump of resin fibers. FIG. 6 is a diagram that illustrates resin fiber fragments. FIG. 7 is a diagram that illustrates loosened resin fibers.

In the description below, an upper position in FIGS. 1 and 2 may be referred to as "above/over" or "upper", and a lower position therein may be referred to as "below/under" or "lower". Since FIGS. 1 and 2 are schematic structure diagrams, positional relationships between components of a fiber structure manufacturing apparatus 100, orientations thereof, sizes thereof, and the like are not limited to the illustrated examples.

The direction in which coarsely crushed pieces M2, a defibrated material M3, a first screened material M4-1, a second screened material M4-2, a first web M5, fragments M6, a mixture M7, a second web M8, and recycled paper S are sent, that is, the direction indicated by arrows in FIG. 1, will be referred to also as "transportation direction".

The side indicated by the head of the arrows in FIG. 1 will be referred to also as "downstream side" in the transportation direction, and the side indicated by the tail of the arrows in FIG. 1 will be referred to also as "upstream side" in the transportation direction. The same holds true for FIG. 2.

The fiber structure manufacturing apparatus 100 illustrated in FIG. 1 is an apparatus for manufacturing a fiber structure from a raw material M1 that is, for example, wastepaper such as used copy paper. In the description below, the recycled paper S is taken as an example of the fiber structure. However, this does not imply any limitation. The fiber structure may have any other shape such as a block shape.

As illustrated in FIG. 1, the fiber structure manufacturing apparatus 100 includes a raw material supplying unit 11, a coarse crushing unit 12, a defibrating unit 13, a screening unit 14, a first web forming unit 15, a fragmenting unit 16, a resin supplying unit 4, a mixing unit 17, a dispersing unit 18, an accumulation unit 19, a shape molding unit 20, a cutting unit 21, a stock unit 22, and a collection unit 27.

The defibrating unit 13, the screening unit 14, the first web forming unit 15, and the fragmenting unit 16 constitute a defibrated material supplying unit 9. The fiber structure manufacturing apparatus 100 manufactures the recycled paper S by performing a mixing of the defibrated material (fragments M6) supplied by the defibrated material supplying unit 9 with resin fibers supplied by the resin supplying unit 4 (loosened resin fibers P2 illustrated in FIGS. 2 and 7), an accumulation, and a shape molding sequentially.

The structure of each component of the fiber structure manufacturing apparatus 100 will now be described.

The raw material supplying unit 11 is a section that performs a raw material supplying process of supplying a raw material M1 to the coarse crushing unit 12. The raw material M1 is a sheet-like material made of fiber-containing matters including cellulose fibers. The cellulose fiber may be any fibrous body whose principal component is cellulose as a compound, and may contain hemicellulose or lignin in addition to cellulose. The form of the raw material M1 is not limited; for example, it may be woven fabric or non-woven fabric. The raw material M1 may be, for example, recycled paper reproduced and manufactured by defibrating waste-paper, may be synthetic YUPO Paper®, or may be non-recycled paper.

The coarse crushing unit 12 is a section that performs a coarse crushing process of coarsely crushing the raw material M1 supplied from the raw material supplying unit 11 in air such as atmospheric conditions. The coarse crushing unit 12 includes a pair of coarse crushing blades 121 and a chute 122.

By rotating in respective directions that are the opposite of each other, the pair of coarse crushing blades 121 is capable of coarsely crushing, that is, shredding, the raw material M1 therebetween into coarsely crushed pieces M2. It is preferable if the coarsely crushed piece M2 has a shape and a size suited for defibration processing to be performed at the defibrating unit 13. Examples of the shape of the coarsely crushed piece M2 include a square or a rectangle, in particular, a strip shape, in a plan view. With regard to the size of the coarsely crushed piece M2, it is preferable if the small pieces have an average length of one side of 100 mm or less, or more preferably, 3 mm or greater and 70 mm or less. The shape of the small piece may be a shape other than a square or a rectangle. It is preferable if the small piece has a thickness of 0.07 mm or greater and 0.10 mm or less.

The chute 122 is disposed under the pair of coarse crushing blades 121 and has a shape like, for example, a funnel. Having this structure, the chute 122 is capable of receiving the coarsely crushed pieces M2 shredded by, and falling from, the coarse crushing blades 121.

A humidifying unit 231 is disposed next to the pair of coarse crushing blades 121 over the chute 122. The humidifying unit 231 humidifies the coarsely crushed pieces M2 in the chute 122. The humidifying unit 231 is a vaporization-type humidifier that includes a non-illustrated filter containing moisture and supplies humidified air with increased humidity to the coarsely crushed pieces M2 by passing air through the filter. Supplying the humidified air to the coarsely crushed pieces M2 makes it possible to prevent the static cling of the coarsely crushed pieces M2 to the chute 122 and the like.

The chute 122 is connected to the upstream-side port of the defibrating unit 13 via a pipe 241. The coarsely crushed pieces M2 having accumulated in the chute 122 are sent to the defibrating unit 13 through the pipe 241.

As illustrated in FIG. 1, the defibrating unit 13 is a section that performs a defibrating process of defibrating the coarsely crushed pieces M2 in air, which means dry defibration. It is possible to produce a defibrated material M3 from the coarsely crushed pieces M2 through the defibration processing performed by the defibrating unit 13. The meaning of the term "defibrate" is to disentangle the coarsely crushed pieces M2 made of plural fibers in a bound form into individual fibers. The result of this disentanglement is the defibrated material M3. The defibrated material M3 has a string shape or a ribbon shape. The defibrated material M3 may be in a state of so-called "lumps", in which defibrated fibers are intertwined with one another in an agglomerated manner.

By rotation of a rotor that is not illustrated, the defibrating unit 13 is capable of producing a flow of air, that is, an airflow, from the coarse crushing unit 12 toward the screening unit 14. By this means, it is possible to take in the coarsely crushed pieces M2 from the pipe 241 at the upstream-side port of the defibrating unit 13, and it is possible to send out the defibrated material M3 to the screening unit 14 through a pipe 242 after the defibration processing.

The pipe 242 is connected to the downstream-side port of the defibrating unit 13. A blower 261, which produces an airflow through rotation of its rotary blades, for example, is provided on a portion located between the ends of the pipe 242. The blower 261 produces an airflow toward the screening unit 14. This facilitates taking the coarsely crushed pieces M2 into the defibrating unit 13 and sending the defibrated material M3 out to the screening unit 14. As will be described later, although the defibrating unit 13 has a structure for smooth passing of the coarsely crushed pieces M2, a raw material, and for smooth defibration processing, the operation of the blower 261 provided downstream of the defibrating unit 13 facilitates the passing of the coarsely crushed pieces M2 inside the defibrating unit 13 and the defibration processing. The blower 261 may be provided upstream of the defibrating unit 13.

The screening unit 14 is a section that performs a screening process of screening the defibrated material M3 according to the lengths of fibers. In the screening unit 14, the defibrated material M3 is sorted into a first screened material M4-1 and a second screened material M4-2, which has a greater fiber length than the first screened material M4-1. The first screened material M4-1 has a size suitable for the subsequent production of recycled paper S. The second screened material M4-2 contains, for example, insufficiently defibrated fibers, excessive agglomeration of defibrated fibers, and the like.

The screening unit 14 includes a drum portion 141 and a housing portion 142 in which the drum portion 141 is housed.

The drum portion 141 is a sieve that has a cylindrical net structure and rotates around its central axis. The defibrated material M3 flows into the drum portion 141. By rotation of the drum portion 141, the defibrated material M3 that is smaller than the mesh of the net is sorted as the first screened material M4-1, and the defibrated material M3 that is larger than the mesh of the net is sorted as the second screened material M4-2.

The first screened material M4-1 falls from the drum portion 141.

On the other hand, the second screened material M4-2 is sent to a pipe 243 connected to the drum portion 141. The pipe 243, at its downstream-side end that is the opposite of an end connected to the drum portion 141, is connected to a portion located between the ends of the pipe 241. The second screened material M4-2 that has flowed through the pipe 243 merges with the coarsely crushed pieces M2 inside the pipe 241 and flows together with the coarsely crushed pieces M2 into the defibrating unit 13. By this means, the second screened material M4-2 is returned to the defibrating unit 13 and is subjected to defibration again together with the coarsely crushed pieces M2.

The first screened material M4-1 dropping from the drum portion 141 falls while being dispersed in air, and travels toward the first web forming unit 15, which is located under the drum portion 141. The first web forming unit 15 is a section that performs a first web forming process of forming a first web M5 from the first screened material M4-1. The first web forming unit 15 includes a mesh belt 151, three stretching rollers 152, and a suction unit 153.

The mesh belt 151 is an endless belt, and the first screened material M4-1 accumulates thereon. The mesh belt 151 is stretched around the three stretching rollers 152. The first screened material M4-1 on the mesh belt 151 is transported downstream by the rotation of the stretching rollers 152.

The first screened material M4-1 has a size larger than the mesh of the mesh belt 151. Therefore, the first screened material M4-1 is unable to pass through the mesh belt 151 and is thus able to accumulate on the mesh belt 151. The first screened material M4-1 is transported downstream together with the mesh belt 151 while accumulating on the mesh belt 151. Therefore, the first web M5 that has a layer shape is formed.

There is a possibility that the first screened material M4-1 contains, for example, dust particles or the like. For example, coarse crushing or defibration could sometimes produce dust particles or the like. The dust particles or the like are collected into the collection unit 27 to be described later.

The suction unit 153 is a suction mechanism that sucks air from below the mesh belt 151. By this means, it is possible to suck dust particles or the like that have passed through the mesh belt 151, together with air.

The suction unit 153 is connected to the collection unit 27 via a pipe 244. The dust particles or the like sucked by the suction unit 153 are collected into the collection unit 27.

A pipe 245 is connected to the collection unit 27. A blower 262 is provided on a portion located between the ends of the pipe 245. By the operation of the blower 262, a suction force can be generated in the suction unit 153. This facilitates the forming of the first web M5 on the mesh belt 151. Dust particles or the like have been removed from the first web M5 formed in this way. The dust particles or the like flow through the pipe 244 to reach the collection unit 27 due to the operation of the blower 262.

The housing portion 142 is connected to a humidifying unit 232. The humidifying unit 232 is a vaporization-type humidifier. Therefore, humidified air is supplied into the housing portion 142. The humidified air humidifies the first screened material M4-1. This prevents the static cling of the first screened material M4-1 to the inner wall of the housing portion 142.

A humidifying unit 235 is disposed downstream of the screening unit 14. The humidifying unit 235 is an ultrasonic humidifier that sprays a mist of water. Ultrasonic misting supplies moisture to the first web M5, thereby adjusting the moisture content of the first web M5. The moisture adjustment prevents the static cling of the first web M5 to the mesh belt 151. Therefore, the first web M5 comes off easily from the mesh belt 151 at a position where the mesh belt 151 is turned back by the stretching roller 152.

The fragmenting unit 16 is disposed downstream of the humidifying unit 235. The fragmenting unit 16 is a section that performs a fragmenting process, in which the first web M5 that has come off from the mesh belt 151 is fragmented. The fragmenting unit 16 includes a propeller 161 that is rotatably supported and a housing portion 162 in which the propeller 161 is housed. It is possible to fragment the first web M5 by rotating the propeller 161. The first web M5 is broken into fragments M6. The fragments M6 fall inside the housing portion 162.

The housing portion 162 is connected to a humidifying unit 233. The humidifying unit 233 is a vaporization-type humidifier. Therefore, humidified air is supplied into the housing portion 162. The humidified air prevents the static cling of the fragments M6 to the propeller 161 or the inner wall of the housing portion 162.

The resin supplying unit 4, which performs a resin supplying process, is connected downstream of the fragmenting unit 16. Resin fibers P supplied from the resin supplying unit 4 go to the mixing unit 17. The mixing unit 17 is a section that performs a mixing process of mixing the fragments M6 with an additive, thereby producing the mixture M7. The structure of the resin supplying unit 4 and the mixing unit 17 will be described in detail later.

The pipe 172 of the mixing unit 17 has a bifurcated structure at its end portion located closer to a drum 181, and these two bifurcated ends are connected to non-illustrated inlets formed in end faces of the drum 181 respectively.

The dispersing unit 18 illustrated in FIG. 1 is a section that performs a dispersing process of dispersing fibers in air while disentangling the fibers intertwined with one another in the mixture M7. The dispersing unit 18 includes the drum 181, which takes in and lets out the mixture M7 that is a defibrated material, and a housing 182 in which the drum 181 is housed.

The drum 181 is a sieve that has a cylindrical net structure and rotates around its central axis. When the drum 181 rotates, fibers, etc. that are smaller than the mesh of the net, among those contained in the mixture M7, are able to pass through the drum 181. In this process, the mixture M7 becomes disentangled and is then discharged together with air. That is, the drum 181 functions as a discharging portion that discharges a material that contains fibers.

The drum 181 is connected to a non-illustrated driving source and rotates due to rotational power outputted from the driving source. The driving source is electrically coupled to a controller 28 illustrated in FIG. 3. The operation of the driving source is controlled by the controller 28.

The housing 182 is connected to a humidifying unit 234. The humidifying unit 234 is a vaporization-type humidifier. Therefore, humidified air is supplied into the housing 182. It is possible to humidify the inside of the housing 182 by means of this humidified air, thereby preventing the static cling of the mixture M7 to the inner wall of the housing 182.

The mixture M7 having been discharged from the drum 181 falls while being dispersed in air and travels toward the accumulation unit 19, which is located under the drum 181. The accumulation unit 19 is a section that performs a second web forming process of forming a second web M8, which is an accumulated material, by causing the mixture M7 to accumulate. The accumulation unit 19 includes a mesh belt 191, stretching rollers 192, and a suction unit 193.

The mesh belt 191 is a mesh member. In the illustrated structure, it is an endless belt. The mixture M7 having been dispersed by and discharged from the dispersing unit 18 accumulates on the mesh belt 191. The mesh belt 191 is stretched around the four stretching rollers 192. The mixture M7 on the mesh belt 191 is transported downstream by the rotation of the stretching rollers 192.

Though the mesh belt 191 is used as an example of the mesh member in the illustrated structure, the scope of the present disclosure is not limited thereto; for example, it may have a shape like a flat plate.

The size of most of the mixture M7 on the mesh belt 191 is larger than the mesh of the mesh belt 191. Therefore, most of the mixture M7 is unable to pass through the mesh belt 191 and is thus able to accumulate on the mesh belt 191. The mixture M7 is transported downstream together with the mesh belt 191 while accumulating on the mesh belt 191. Therefore, the second web M8 that has a layer shape is formed.

The suction unit 193 is a suction mechanism that sucks air from below the mesh belt 191. By this means, it is possible to suck the mixture M7 onto the mesh belt 191, thereby facilitating the accumulation of the mixture M7 on the mesh belt 191.

A pipe 246 is connected to the suction unit 193. A blower 263 is provided on a portion located between the ends of the pipe 246. By the operation of the blower 263, a suction force can be generated in the suction unit 193.

A humidifying unit 236 is disposed downstream of the dispersing unit 18. The humidifying unit 236 is an ultrasonic humidifier, similarly to the humidifying unit 235. Ultrasonic misting supplies moisture to the second web M8, thereby adjusting the moisture content of the second web M8. The moisture adjustment prevents the static cling of the second web M8 to the mesh belt 191. Therefore, the second web M8 comes off easily from the mesh belt 191 at a position where the mesh belt 191 is turned back by the stretching roller 192.

The total content of the moisture added by the humidifying units 231 to 236 may preferably be, for example, 0.5 parts by mass or more and 20 parts by mass or less with respect to 100 parts by mass of the material before humidification.

The shape molding unit 20 is disposed downstream of the accumulation unit 19. The shape molding unit 20 is a section that performs a sheet forming process of forming recycled paper S from the second web M8. The shape molding unit 20 includes a pressing portion 201 and a heating portion 202.

The pressing portion 201 includes a pair of calendar rollers 203, and is capable of pressing the second web M8 between the calendar rollers 203 without heating. This increases the density of the second web M8. When heat is applied, a preferred degree of heating is, for example, a degree that does not cause the melting of the resin fibers P. The second web M8 with increased density is transported toward the heating portion 202. One of the pair of calendar rollers 203 is a drive roller that is driven by the operation of a motor that is not illustrated, and the other is a driven roller.

The heating portion 202 includes a pair of heating rollers 204, and is capable of applying pressure while heating the second web M8 between the heating rollers 204. The heating and pressing causes the melting of the resin fibers P in the second web M8. The molten resin fibers P bond the fibers together. By this means, the recycled paper S is formed. The recycled paper S is transported toward the cutting unit 21. One of the pair of heating rollers 204 is a drive roller that is driven by the operation of a motor that is not illustrated, and the other is a driven roller.

The cutting unit 21 is disposed downstream of the shape molding unit 20. The cutting unit 21 is a section that performs a cutting process of cutting the recycled paper S. The cutting unit 21 includes a first cutter 211 and a second cutter 212.

The first cutter 211 cuts the recycled paper S in a direction that intersects with the transportation direction of the recycled paper S, in particular, a direction that is orthogonal thereto.

The second cutter 212 cuts the recycled paper S in a direction parallel to the transportation direction of the recycled paper S downstream of the first cutter 211. The purpose of this cutting is to remove both of unnecessary widthwise edge portions of the recycled paper S so as to adjust the width of the recycled paper S.

The recycled paper S having a desired shape and a desired size can be obtained by cutting with the first cutter 211 and the second cutter 212 described above. The recycled paper S is further transported downstream to the stock unit 22 and is stored thereon.

Next, the structure of the resin supplying unit 4 and the mixing unit 17 will now be described.

As illustrated in FIG. 2, the resin supplying unit 4 has a function of supplying the resin fibers P serving as a binder for bonding the fibers of the fragments M6, the defibrated material, together. The resin supplying unit 4 includes a fragmenting unit 41, a constant amount supplying unit 42, a loosening unit 43, and a transferring unit 44.

The fragmenting unit 41 produces a plurality of resin fiber fragments P1 illustrated in FIG. 6 by performing fragmentation of a cotton-like lump P0 of the resin fibers P illustrated in FIG. 5. The fragmentation performed by the fragmenting unit 41 is to produce the plurality of resin fiber fragments P1 the number of which is, for example, three or more and one thousand or less or so by breaking one lump P0 into them.

The size, weight, density, etc. of the resin fiber fragments P1 produced through the fragmentation from the lump P0 should preferably be as uniform as possible; however, some degree of deviation may exist among them. For example, the one having the maximum size (diameter) or the maximum weight among the resin fiber fragments P1 produced through the fragmentation from the lump P0 may preferably be 1.2 times or more and 200 times or less, or more preferably, twice or more and 50 times or less as large/heavy as the one having the minimum size (diameter) or the minimum weight among them.

The density $\rho 0$ of the resin fibers P in the lump P0 and the density $\rho 1$ of the resin fibers P in the resin fiber fragments P1 have an average value of, for example, 0.05 g/cm$^3$ or greater and 2.0 g/cm$^3$ or less or so.

The constituent materials, structure (layer structure, etc.), and dimensions such as length and size of the resin fibers P are not specifically limited; however, in the present embodiment, they are as follows.

As illustrated in FIG. 4, the resin fiber P has a double-layer structure including a core 101 and a cover layer 102. The outer circumferential portion of the core 101 is covered by the cover layer 102. The melting point of the cover layer 102 is lower than that of the core 101.

The combination of the material of the core 101 and the material of the cover layer 102 is not specifically limited. Some examples of the combination of the core 101/cover layer 102 are polypropylene/polyethylene, polyester/polyethylene, high-melt-strength polypropylene/low-melt-strength polypropylene, polyester/polypropylene, polyamide/polyethylene, etc.

The average fiber length of the resin fibers P is not specifically limited; for example, it may preferably be 0.5 mm or greater and 100 mm or less, or more preferably, 3 mm or greater and 80 mm or less. This makes it possible to enhance the strength of the recycled paper S.

As described above, the resin fiber P includes the core 101 and the cover layer 102 covering the outer circumferential portion of the core 101 and having a melting point lower than that of the core 101. This ensures a sufficient strength offered by the core 101 and an excellent function as a binder for bonding the fibers of the defibrated material together by the cover layer 102. Therefore, it is possible to enhance the strength of the recycled paper S effectively.

However, the structure of the resin fiber P is not limited to this example. The resin fiber P may have a single-layer structure, or a multiple-layer structure including three layers or more. The materials constituting the layers of the resin fiber P or the combination of the materials, and the high/low relationship between the melting points, are also not specifically limited.

As illustrated in FIG. 2, the fragmenting unit 41 includes two rotating bodies 411 and a housing 412 in which the two rotating bodies 411 are housed. A feed port 415 through which the cotton-like lump P0 of the resin fibers P is supplied into the housing 412 is provided in the top of the housing 412.

The rotating body 411 includes a shaft 413 and a plurality of blades 414 provided on the outer circumferential portion of the shaft 413. The plurality of blades 414 is provided along the radial direction of the shaft 413 and along the longitudinal direction of the shaft 413.

Each of the rotating bodies 411 is rotatably supported at its one end portion to the housing 412 by a bearing that is not illustrated. Each of the rotating bodies 411 is disposed such that the blades 414 of the rotating body 411 arranged adjacently overlap in the longitudinal direction of the shaft 413, with a space from each other.

The rotating body 411 that is the upper one of the rotating bodies 411 is coupled to a motor MT1 and is configured to rotate on its axis due to rotational driving by the motor MT1. The rotating bodies 411 each include non-illustrated gears provided on an outer portion of the housing 412 and are configured to rotate in directions opposite to each other by interlocked operation due to meshing of the gears.

As illustrated in FIG. 3, the motor MT1 is electrically coupled to the controller 28 via a non-illustrated motor driver. The controller 28 controls the conditions of current application to the motor driver. By this control, the motor MT1 rotates at a desired timing and at a desired rotation speed.

Due to the rotation of each of the rotating bodies 411, the cotton-like lump P0 of the resin fibers P fed into the housing 412 is broken into pieces by the blades 414, and the resin fiber fragments P1 are produced in this way. As will be described later, the resin fiber fragments P1 are more suited for constant amount supply than the lump P0.

The number of the rotating bodies 411 provided may be one, or three or more. The rotation axis of the rotating body 411 may be oriented vertically. The rotating bodies 411 may be configured to rotate independently of each other. In this case, the rotating bodies 411 may rotate in the same direction or in opposite directions.

The housing 412 includes the feed port 415, through which the cotton-like lump P0 of the resin fibers P is supplied, an outlet port 416, through which the resin fiber fragments P1 go out. The upstream-side end of a pipe 417 is connected to the outlet port 416. The lump P0 of the resin fibers P may be configured to be supplied through the feed port 415 automatically or configured to be supplied through the feed port 415 by an operator manually.

As described above, the fragmenting unit 41 includes at least one rotating body 411 that includes the plurality of blades 414, two rotating bodies in the present embodiment, and the housing 412 in which the rotating bodies 411 are housed, and the cotton-like lump P0 of the resin fibers P is broken into fragments by the blades 414. This makes it possible to process the lump P0 of the resin fibers P into form that is more suited for constant amount supply.

The resin fiber fragments P1 produced by the fragmenting unit 41 go out through the outlet port 416 and are sent to the constant amount supplying unit 42 through the pipe 417.

The constant amount supplying unit 42 has a function of supplying a constant amount of the resin fiber fragments P1. The constant amount supply performed by the constant amount supplying unit 42 means discharging a predetermined amount of the resin fiber fragments P1 in a stable manner while weighing the resin fiber fragments P1. In the present embodiment, the constant amount supplying unit 42 discharges a predetermined amount of the resin fiber fragments P1 each time intermittently. However, this does not imply any limitation. The constant amount supplying unit 42 may be configured to discharge the resin fiber fragments P1 continuously.

The constant amount supplying unit 42 includes a reservoir portion 421, which stores the resin fiber fragments P1, and a measurement portion 422, which weighs the resin fiber fragments P1.

The reservoir portion 421 includes a container 423 and an opening-and-closing portion 424 provided on the bottom of the container 423. The container 423 includes an inlet port 429 and an outlet port 425. The inlet port 429 is provided in the top of the container 423. The downstream-side end of the pipe 417 is connected to the inlet port 429. The outlet port 425 is provided in the bottom of the container 423. The resin fiber fragments P1 go out through the outlet port 425. The opening-and-closing portion 424 is provided on the outlet port 425.

Stirring blades configured to stir the produced resin fiber fragments P1 may be provided inside the container 423.

The opening-and-closing portion 424, for example, a solenoid valve, a shutter, or the like, adjusts the degree of opening of the outlet port 425. In the present embodiment, the opening-and-closing portion 424 is configured to switch the outlet port 425 between an open state and a closed state. When the outlet port 425 is in an open state, the resin fiber fragments P1 are discharged through the outlet port 425 of the container 423 to be supplied to the measurement portion 422. When the outlet port 425 is in a closed state, the resin fiber fragments P1 are not discharged through the outlet port 425, and the supply of the resin fiber fragments P1 to the measurement portion 422 is thus stopped.

The opening-and-closing portion 424 may be configured to adjust the degree of opening of the outlet port 425 in multiple steps or in a step-less manner.

As illustrated in FIG. 3, the driving source of the opening-and-closing portion 424 is electrically coupled to the controller 28. The controller 28 controls the conditions of current application to the opening-and-closing portion 424, thereby controlling the opening-and-closing conditions of the opening-and-closing portion 424. The timing of an open state and a closed state of the opening-and-closing portion 424 and the length of time of the open state are adjusted by the control by the controller 28. By this means, the reservoir portion 421 is capable of discharging the resin fiber fragments P1 through the outlet port 425 intermittently.

The measurement portion 422 includes a conveyor belt 426, a pair of rollers 427, and a load measurement portion 428.

The conveyor belt 426 is an endless belt stretched around the pair of rollers 427 spaced from each other. The conveyor belt 426 receives, at its upper surface, the resin fiber fragments P1 having been discharged through the outlet port 425, and conveys the resin fiber fragments P1 toward the loosening unit 43, which will be described later. The resin fiber fragments P1 having been conveyed to the left end of the conveyor belt 426 illustrated in FIG. 2 fall down to be supplied into the pipe 417.

One of the pair of rollers 427 is a drive roller that is driven by the operation of a motor MT2, and the other is a driven roller. The rotation speed of the motor MT2 determines the conveyance speed of the conveyor belt 426.

As illustrated in FIG. 3, the motor MT2 is electrically coupled to the controller 28 via a non-illustrated motor driver. The controller 28 controls the conditions of current application to the motor driver. By this control, the motor MT2 rotates at a desired timing and at a desired rotation speed.

One feed of the resin fiber fragments P1 supplied intermittently is supplied onto the conveyor belt 426. When this one feed is supplied to the pipe 417, the next one feed of the resin fiber fragments P1 is supplied onto the conveyor belt 426. This process is thereafter repeated. The operation timing of the motor MT2 and the rotation speed thereof are set in such a way as to realize this operation.

The load measurement portion 428 has a function of measuring a load applied to the conveyor belt 426. In the present embodiment, the load measurement portion 428 supports the upstream-side roller 427, which is one of the pair of rollers 427, and measures the load (weight) applied to the conveyor belt 426 via the roller 427.

The load measurement portion 428 is, for example, a load cell, and is electrically coupled to the controller 28 as illustrated in FIG. 3. The measurement result detected by the load measurement portion 428, that is, information regarding the load, is transmitted to the controller 28 on a real-time basis in the form of an electric signal.

The controller 28 calculates the load applied to the conveyor belt 426 on the basis of the information (electric signal) received from the load measurement portion 428. The load applied to the conveyor belt 426 increases and decreases in accordance with the weight of the resin fiber fragments P1 supplied onto the conveyor belt 426. By this means, the controller 28 is capable of calculating the weight of the supplied one feed of the resin fiber fragments P1.

The controller 28 adjusts the timing of an open state and a closed state of the opening-and-closing portion 424 and the length of time of the open state on the basis of the weight of the resin fiber fragments P1. This adjustment will now be described in detail.

If the weight of one feed of the resin fiber fragments P1 is within a predetermined numerical range, the controller 28 puts the opening-and-closing portion 424 into an open state at a predetermined timing, and puts the opening-and-closing portion 424 into a closed state upon a lapse of predetermined time.

On the other hand, if the weight of one feed of the resin fiber fragments P1 is not within the predetermined numerical range, the controller 28 adjusts the time for which the opening-and-closing portion 424 is in an open state. For example, the time for which the opening-and-closing portion 424 is in an open state is made longer if the weight of one feed of the resin fiber fragments P1 is less than the lower limit of a predetermined numerical range, and the time for which the opening-and-closing portion 424 is in an open state is made shorter if the weight of one feed of the resin fiber fragments P1 is greater than the upper limit of the predetermined numerical range.

In these cases, the degree of opening of the opening-and-closing portion 424 is assumed to be fixed when the opening-and-closing portion 424 is in an open state.

The adjustment described above is performed on the basis of, for example, data representing a relationship between an amount of supply of the resin fiber fragments P1 and time for which an open state is kept. Upon calculating the weight of one feed of the resin fiber fragments P1, the controller 28 looks up the data described above to determine the time for which an open state is kept. The data is in the form of a calibration curve, a table, an arithmetic expression, or the like, is stored in a storage unit 282, and is read out to be used for arithmetic processing when needed.

Since the controller 28 performs feedback control described above, it is possible to make the weight of the resin fiber fragments P1 supplied into the pipe 417 more constant. More particularly, in the fiber structure manufacturing apparatus 100, the resin fiber fragments P1 are produced through fragmentation of the lump P0 of the resin fibers P by the fragmenting unit 41, and constant amount supply is performed on the basis of the weight of the resin fiber fragments P1. With this configuration, it is possible to moderate an increase and a decrease in the weight of one feed of the resin fiber fragments P1 arising from the adjustment of the length of the time for which the opening-and-closing portion 424 is in an open state. Therefore, it is possible to adjust the amount of supply of the resin fiber fragments P1 with higher precision. Consequently, the resin supplying unit 4 fulfills excellent constant-amount performance and thus enhances the quality of the recycled paper S.

The volume of the resin fiber fragments P1 may be measured, and, constant amount supply may be performed on the basis of the result of the measurement. Since there is a certain correlation between the weight and volume of the resin fiber fragments P1, the same effects as those described above can be produced also when the constant amount supply is performed on the basis of the result of the measurement of the volume of the resin fiber fragments P1.

The controller 28 does not necessarily have to perform the feedback control described above. That is, the controller 28 may be configured to control the opening and closing of the opening-and-closing portion 424 at a predetermined timing. In this case, the load measurement portion 428 can be omitted.

The resin fiber fragments P1 supplied by the constant amount supplying unit 42 described above go to the loosening unit 43 through the pipe 417.

The loosening unit 43 loosens the resin fiber fragments P1 to decrease the density of the resin fiber fragments P1. The loosening unit 43 includes a first airflow agitation device 431. The first airflow agitation device 431 is a blower equipped with rotary blades inside. The first airflow agitation device 431 includes an inlet port 432, through which the resin fiber fragments P1 are taken in, and an outlet port 433, through which the produced loosened resin fibers P2 go out.

The first airflow agitation device 431 includes a motor MT3 configured to rotate the rotary blades of the blower. As illustrated in FIG. 3, the motor MT3 is electrically coupled to the controller 28 via a non-illustrated motor driver. The controller 28 controls the conditions of current application to the motor driver. By this control, the motor MT3 rotates at a desired timing and at a desired rotation speed.

When the rotary blades provided inside the first airflow agitation device 431 rotate due to the operation of the motor MT3, a flow of air is produced, and the resin fiber fragments P1 are taken into the first airflow agitation device 431 through the inlet port 432. The resin fiber fragments P1 having been taken in through the inlet port 432 are stirred by the flow of air produced by the rotation of the rotary blades. This airflow agitation loosens the resin fiber fragments P1 in a cotton-like manner. That is, the loosened resin fibers P2 illustrated in FIG. 7 are produced with an increase in the volume of voids in the resin fiber fragments P1 and a decrease in the density of the resin fiber fragments P1. The produced loosened resin fibers P2 go out through the outlet port 433.

The density ρ2 of the resin fibers P in the loosened resin fibers P2, though not specifically limited, may preferably be 0.001 g/cm$^3$ or greater and 0.5 g/cm$^3$ or less, or more preferably, 0.008 g/cm$^3$ or greater and 0.1 g/cm$^3$ or less. This makes it possible to better mix the resin fibers P with the fibers of the fragments M6.

Let A (g/cm$^3$) be the density of the resin fibers P in the resin fiber fragments P1. Let B (g/cm$^3$) be the density of the resin fibers P in the loosened resin fibers P2. When these definitions are given, B/A, though not specifically limited, may preferably be 0.01 or greater and 0.5 or less, or more preferably, 0.01 or greater and 0.4 or less, or still more preferably, 0.03 or greater and 0.3 or less.

If the intensity of loosening at the loosening unit 43 is high, the value of B/A could be less than the lower limit mentioned above. In this case, there is a risk of an increase in damage to the resin fibers P. If the resin fibers P are damaged significantly, the resin fibers P will be broken, resulting in shorter fiber lengths, fiber cracks, or fiber splitting; therefore, there is a risk of a decrease in strength of recycle paper that is obtained or instability in the strength.

On the other hand, if the intensity of loosening at the loosening unit 43 is low, the value of B/A could be greater than the upper limit mentioned above. In this case, though the damage to the resin fibers P is little, the effect of loosening might be insufficient for the state of the resin fiber fragments P1, especially depending on the value of the density A thereof.

Therefore, setting the value of B/A within the above range makes it possible to better disperse and mix the resin fibers P and the fragments M6 while suppressing the damage to the resin fibers P. Consequently, the recycled paper S of high quality, that is, the recycled paper S having good surface properties with little surface roughness and waviness, and with reductions in unevenness in strength and unevenness in thickness, can be obtained.

The loosened resin fibers P2 produced by the first airflow agitation device 431 go out through the outlet port 433 and are then sent to the mixing unit 17 by the transferring unit 44. The transferring unit 44 includes a pipe 441. The upstream-side end of the pipe 441 is connected to the outlet port 433 of the first airflow agitation device 431. The downstream-side end of the pipe 441 is connected to a portion located between the ends of the pipe 172 of the mixing unit 17. That is, as illustrated in FIG. 2, at the border portion between the transferring unit 44 and the mixing unit 17, the pipe 172 and the pipe 441 form a bifurcated pipe such as a T-shaped pipe, a Y-shaped pipe, or a straight-main-with-oblique-branch pipe, which includes a junction portion 170 where the pipe 441 and the pipe 172 are connected to each other such that the internal flow passages of the two meet.

As illustrated in FIGS. 1 and 2, the mixing unit 17 includes the pipe 172 and a second airflow agitation device 173.

The pipe 172 is a flow passage which connects the housing portion 162 of the fragmenting unit 16 illustrated in FIG. 1 and the housing 182 of the dispersing unit 18 illustrated therein and through which the mixture M7 of the fragments M6 and the resin fibers P flows.

The second airflow agitation device 173 is provided on a portion located between the ends of the pipe 172 at a position downstream of the junction portion 170. The second airflow agitation device 173, similarly to the first airflow agitation device 431, is a blower equipped with rotary blades inside, and includes a motor MT4 configured to rotate the rotary blades.

As illustrated in FIG. 3, the motor MT4 is electrically coupled to the controller 28 via a non-illustrated motor driver. The controller 28 controls the conditions of current application to the motor driver. By this control, the motor MT4 rotates at a desired timing and at a desired rotation speed.

The loosened resin fibers P2 having been supplied into the pipe 172 through the pipe 441 of the resin supplying unit 4 merges with the fragments M6 coming from the upstream side of the pipe 172 to turn into the mixture M7. The mixture M7 is further sent downstream inside the pipe 172 and passes through the second airflow agitation device 173.

The fragments M6 and the loosened resin fibers P2 that are included in the mixture M7 are stirred at the second airflow agitation device 173 by a flow of air produced due to the rotation of the rotary blades. This airflow agitation further loosens the fragments M6 and the loosened resin fibers P2 that are included in the mixture M7, thereby putting the mixture M7 into a state in which cellulose fibers that constitute the fragments M6 and the resin fibers P that constitute the loosened resin fibers P2 are dispersed and mixed uniformly. The mixture M7 in this state is sent to the dispersing unit 18 of the next step.

The mixing unit 17 includes a second airflow agitation device 173 configured to stir the mixture M7 by using airflow agitation. This makes it possible to put the mixture M7 into a state in which cellulose fibers that constitute the fragments M6 and the resin fibers P that constitute the loosened resin fibers P2 are dispersed and mixed uniformly. Therefore, the fiber structure that is manufactured, that is, the recycled paper S, is more uniform in terms of strength and thickness of each part and has good surface properties, and is thus of high quality.

Each component of the fiber structure manufacturing apparatus 100 described above is electrically coupled to the controller 28. The operation of each component is controlled by the controller 28.

As illustrated in FIG. 3, the controller 28 includes a control unit 281, a storage unit 282, and a communication unit 283.

The control unit 281 includes at least one processor and executes various programs stored in the storage unit 282. For example, a CPU (Central Processing Unit) can be used as the processor. The control unit 281 has functions of performing various kinds of control related to sheet manufacturing such as functions of controlling the components of the fiber structure manufacturing apparatus 100, for example, the opening-and-closing portion 424, the motor MT1, the motor MT2, the motor MT3, the motor MT4, and the like.

In addition, as described earlier, the control unit 281 controls the operation of the opening-and-closing portion 424 on the basis of the measurement result of the load measurement portion 428.

Programs for executing the various functions described above and data representing a relationship between the resin fiber fragments P1 and the time for which the open state of the opening-and-closing portion 424 is kept as described above are stored in the storage unit 282.

The communication unit 283 is, for example, an I/O interface, and performs communication with the components of the fiber structure manufacturing apparatus 100. In addition, the communication unit 283 has a function of communicating with a non-illustrated computer and/or a non-illustrated server via a network, for example.

The controller 28 may be built in the fiber structure manufacturing apparatus 100. The controller 28 may be provided in an external device such as an external computer.

The control unit 281 and the storage unit 282 may be, for example, configured as a single integrated unit. The control unit 281 may be built in the fiber structure manufacturing apparatus 100, with the storage unit 282 provided in an external device such as an external computer. The storage unit 282 may be built in the fiber structure manufacturing apparatus 100, with the control unit 281 provided in an external device such as an external computer.

In these cases, the external device may be connected to the components of the fiber structure manufacturing apparatus 100 via a network such as, for example, the Internet or an intranet.

As explained above, the fiber structure manufacturing apparatus 100 includes: the defibrated material supplying unit 9 that supplies the fragments M6 as an example of a defibrated material obtained by defibrating a material that contains fibers; the resin supplying unit 4 that supplies the resin fibers P; the mixing unit 17 that produces the mixture M7 by mixing the fragments M6 with the resin fibers P; the accumulation unit 19 that produces the second web M8, which is an example of an accumulated material, by causing the mixture M7 to accumulate; and the shape molding unit 20 that produces a fiber structure by performing shape molding of the second web M8, wherein the resin supplying unit 4 includes the fragmenting unit 41 that produces the resin fiber fragments P1 by performing fragmentation of the cotton-like lump P0 of the resin fibers P, the constant amount supplying unit 42 that supplies a constant amount of the resin fiber fragments P1 produced by the fragmenting unit 41, the loosening unit 43 that loosens the resin fiber fragments P1 supplied from the constant amount supplying unit 42 to decrease the density of the resin fiber fragments P1, and the transferring unit 44 that transfers the resin fibers P like a cotton loosened by the loosening unit 43 to the mixing unit 17. With this configuration, it is possible to mix the fragments M6 as the defibrated material with the resin fiber fragments P1 uniformly. In particular, it is possible to disperse and mix cellulose fibers and the resin fibers P uniformly in a fiber level beyond a fragment level. Therefore, the fiber structure that is manufactured, that is, the recycled paper S, is more uniform in terms of strength and thickness of each part and has good surface properties, and is thus of high quality.

As described earlier, the loosening unit 43 includes the first airflow agitation device 431 that loosens the resin fiber fragments P1 by using airflow agitation. This makes it possible to loosen the resin fibers P effectively while suppressing the damage to the resin fibers P.

Note that this configuration is just a non-limiting example. The loosening unit 43 may be configured to loosen the resin fiber fragments P1 by, for example, rotation of a stirring member such as rotary blades.

As described earlier, B/A is 0.01 or greater and 0.5 or less, where A denotes, in unit of $g/cm^3$, density of the resin fibers P in the resin fiber fragments P1, and B denotes, in unit of $g/cm^3$, density of the resin fibers P2 like a cotton loosened by the loosening unit 43. With this configuration, at the loosening unit 43, it is possible to loosen the resin fibers P sufficiently without damaging the resin fibers P and, therefore, it is possible to better disperse and mix the resin fibers P and the fragments M6. Consequently, the recycled paper S of high quality with uniform strength and uniform thickness and good surface properties can be obtained.

Although a fiber structure manufacturing apparatus according to the illustrated embodiments has been described above, the scope of the present disclosure is not limited to the foregoing examples. The components constituting the fiber structure manufacturing apparatus may be replaced with any alternatives that fulfill the same functions. Any additional component may be included in the fiber structure manufacturing apparatus.

In the fiber structure manufacturing apparatus, the raw material supplying unit 11 and the coarse crushing unit 12 may be omitted. In this case, a coarsely-crushed-pieces supplying unit that supplies coarsely crushed pieces can be provided in place of the raw material supplying unit 11 and the coarse crushing unit 12.

What is claimed is:

1. A fiber structure manufacturing apparatus, comprising:

a defibrated material supplying unit that supplies a defibrated material obtained by defibrating a material that contains fibers;

a resin supplying unit that supplies loosen resin fibers in a cotton-like form, each of the loosen resin fibers being a resin in a fiber-shape, the resin supplying unit including a fragmenting unit that produces resin fiber fragments by performing fragmentation of a cotton-like lump of resin fibers, a constant amount supplying unit that supplies a constant amount of the resin fiber fragments produced by the fragmenting unit, a loosening unit that loosens the resin fiber fragments supplied from the constant amount supplying unit to decrease density of the resin fiber fragments, and a transferring unit including a first pipe that transfers, to the mixing unit, the loosen resin fibers in the cotton-like form that are obtained by loosening the resin fiber fragments at the loosening unit;

a mixing unit that produces a mixture by mixing the defibrated material with the loosen resin fibers, the mixing unit including a second pipe, the second pipe having an upstream end through which the defibrated material supplied from the defibrated material supplying unit enters the second pipe, a downstream end that is opposite to the upstream end in a transferring direction of the defibrated material, and a junction portion that is positioned downstream relative to the upstream end and upstream relative to the downstream end in the transferring direction, at which the first pipe of the transferring unit and the second pipe are connected, and at which the loosen resin fibers from the transferring unit meet the defibrated material entered from the upstream end, the first pipe of the transferring unit and the second pipe forming a bifurcated pipe;

an accumulation unit that produces an accumulated material by causing the mixture to accumulate; and a shape molding unit that produces a fiber structure by performing shape molding of the accumulated material.

2. The fiber structure manufacturing apparatus according to claim 1, wherein the loosening unit includes a first airflow agitation device that loosens the resin fiber fragments by using airflow agitation.

3. The fiber structure manufacturing apparatus according to claim 1, wherein the mixing unit includes a second airflow agitation device that stirs the mixture by using airflow agitation.

4. The fiber structure manufacturing apparatus according to claim 1, wherein the loosening unit loosens the resin fiber fragments such that B/A is 0.01 or greater and 0.5 or less, where density of resin fibers in the resin fiber fragments is A in unit of $g/cm^3$, and the density of the loosen resin fibers is B in unit of $g/cm^3$.

5. The fiber structure manufacturing apparatus according to claim 1, wherein the fragmenting unit includes at least one rotating body that includes a plurality of blades, and a housing in which the rotating body is housed, and due to rotation of the rotating body, the cotton-like lump of the resin fibers is broken into the resin fiber fragments by the blades.

6. The fiber structure manufacturing apparatus according to claim 1, wherein the resin supplying unit supplies the loosen resin fibers each of which includes a core, and a cover layer that covers an outer circumferential portion of the core and has a melting point lower than a melting point of the core.

* * * * *